US007036548B2

(12) United States Patent
Johnston et al.

(10) Patent No.: US 7,036,548 B2
(45) Date of Patent: May 2, 2006

(54) METHOD AND APPARATUS FOR POSITIONING A SECTIONAL DOOR RELATIVE TO AN OPENING

(75) Inventors: Edward C. Johnston, Dalton, OH (US); James M. West, Dellroy, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 28 days.

(21) Appl. No.: 10/803,524

(22) Filed: Mar. 17, 2004

(65) Prior Publication Data

US 2005/0205220 A1 Sep. 22, 2005

(51) Int. Cl.
*E05D 15/06* (2006.01)

(52) U.S. Cl. ..... 160/201; 292/303

(58) Field of Classification Search ..... 160/201, 160/207, 209, 40, 405; 16/96 R, 94 R, 86 B, 16/85; 292/303, 34.12, 34.13, 23, DIG. 46, 292/341.15

See application file for complete search history.

(56) References Cited

U.S. PATENT DOCUMENTS

| | | | | |
|---|---|---|---|---|
| 2,643,714 | A * | 6/1953 | Wolf | 160/191 |
| 2,703,247 | A * | 3/1955 | Wolf et al. | 292/220 |
| 2,846,254 | A * | 8/1958 | Forest | 160/201 |
| 6,047,761 | A * | 4/2000 | Jaehnen et al. | 160/201 |
| 6,076,589 | A * | 6/2000 | Hormann | 160/201 |
| 6,089,304 | A | 7/2000 | Mullet et al. | 160/209 |
| 6,412,757 | B1 | 7/2002 | Ohno et al. | 267/36.1 |

OTHER PUBLICATIONS

9 Sheets of photographs of Hörmann KG device for retaining rollers of a sectional door, date unknown.

* cited by examiner

*Primary Examiner*—David Purol
(74) *Attorney, Agent, or Firm*—Renner Kenner Greive; Bobak Taylor & Weber

(57) ABSTRACT

A roller stop (50) for a sectional door (D) having a plurality of hinged panels 20, rollers (30) attached to the panels, and a pair of tracks (T, T') receiving the rollers for guiding the sectional door between a closed vertical position and an open horizontal position, the roller stop having a body portion (27), and at least one clamping member 67, 68 associated with the body portion adapted to engage one of the tracks, wherein the body portion is adapted to contact at least one of the rollers to temporarily maintain the sectional door in a predetermined position.

9 Claims, 10 Drawing Sheets

METHOD AND APPARATUS FOR POSITIONING A SECTIONAL DOOR RELATIVE TO AN OPENING

TECHNICAL FIELD

The present invention relates generally to a method and apparatus for positioning a sectional door relative to the opening in which the sectional door is operatively positioned. More particularly, the present invention relates to a method and apparatus for a sectional door provided in a residential garage or utility building in the fully open position. More specifically, the present invention relates to a method and apparatus for positioning and maintaining a sectional door in the fully open position outside the door opening.

BACKGROUND ART

Oftentimes, a sectional door of the type used in openings of residential garages, utility buildings, and the like will not be retracted into the fully open position. That is, when "open," all the panels of the sectional door are not oriented in a substantially horizontal position with the result that the bottom panel hangs down into the door opening.

There are several reasons why a sectional door is not retracted into a fully open position, thereby allowing the bottom panel to hang down into the door opening. For example, the spring in the counterbalance system attached to the sectional door tends to distend over a period of time. Therefore, although the counterbalance system could have originally operated to hold the sectional door in fully open, substantially horizontal position, the distension of the spring prevents the counterbalance system from counteracting the force of gravity, and the bottom panel of the sectional door hangs down into the door opening.

Furthermore, when sectional doors are configured for low headroom operation, these sectional doors characteristically hang down into the door opening. For example, sectional doors must be configured for low headroom installations when the top of the opening is close to the ceiling of the residential garage or utility building. To fit in the confined space, the counterbalance system used for low headroom installations is located directly adjacent the top of the opening, and proximate the transitional portions of the tracks.

Like other counterbalance systems, the springs of the counterbalance systems used for low headroom operation are loaded as the sectional door moves into the fully closed position and unloaded as the sectional door opens. Therefore, the unloading of the spring produces forces which assist with the opening movement of the sectional doors. Normally, the spring would assist with opening of the sectional door to the fully open position where all of the panels are all substantially horizontal. However, in the counterbalance systems used for low headroom operation, the spring is capable of assisting with the opening of the sectional door only to heights below the fully open position.

The location of the counterbalance system used for low headroom operation proximate the transitional portions of the tracks prevents the opening of the sectional door to the fully open position. For example, as the sectional door is opening, the spring of the counterbalance system is predisposed to retract cables attached to the lower extremities of the bottom panels. That is, the spring functions to reeve as much length of the cables around cable storage drums as possible to assist with the opening of the sectional door. In this respect, the lower extremities of the bottom panels are pulled into a counterbalance point by the reeving of the cables.

Like other counterbalance systems, the counterbalance system used for low headroom operation effectively biases the lower extremities of the bottom panels into the counterbalance point. However, because of the location of the counterbalance system used for low headroom operation relative to the transitional track portions, the counterbalance point is along these transitional track portions. As such, the spring is capable of assisting with the opening of the sectional door only to heights below the fully open position, and the lower panel of a sectional door configured for low headroom operation hangs down into the door opening.

The decrease in the effective height of the door opening due to the position of the counterbalance point was not a problem when mostly automobiles were being parked in residential garages and utility buildings. However, more recently, there are an increasing number of tall vehicles owned by consumers, such as vans and sport utility vehicles. These taller vehicles require additional clearance, and may not fit within the opening if there is significant hang down. This problem is compounded when a driveway angles downwardly toward the opening. When the opening is below level, the angled orientation of the vehicles upon entering the door opening requires still additional clearance. Such additional clearance may be unavailable if the bottom panel hangs down into the door opening.

One solution to eliminate the above-discussed hang down and increase the effective height of the door opening is to provide powered mechanical operating systems that pull the sectional door past the counterbalance point. As such, even when the sectional door is configured for low headroom operation, these mechanical operating systems retract the sectional door away from the top of the opening. However, many of the mechanical operating systems will not hold the sectional door in the fully open position for extended periods of time, thereby allowing the lower panel to move back into a hang down position in the opening.

Because many of the mechanical operating systems will not maintain the sectional door in the fully open, substantially horizontal position, the user must reactivate the mechanical operating system to retract the sectional door to the fully open position before a tall vehicle can safely enter or exit the door opening. If the user forgets to reactivate the mechanical operating system, damage will occur to both the vehicle and the sectional door.

Another solution to eliminate the above-discussed hang down and increase the effective height of the door opening is to build residential garages and utility buildings with ceiling heights greater than nine feet. Such ceiling heights allow conventional counterbalance systems to be used. For example, conventional counterbalance systems require the cable storage drums to be positioned at a height greater than the horizontal portions of the tracks. Such positioning permits the conventional counterbalance systems to locate the counterbalance point such that the sectional door is raised as high as possible in the door opening. These conventional counterbalance systems require at least thirteen to fourteen inches between the top of the opening and the ceiling to permit proper mounting. Therefore, a disadvantage of these conventional counterbalance systems is the inability to use such systems for low headroom operation in a preexisting structure where the top of the opening is close to the ceiling.

Consequently, the use of conventional counterbalance systems may not be possible in pre-existing residential garages and utility buildings. In fact, use of conventional counterbalance systems may also not be possible in new construction. For example, construction parameters frequently dictate a lower ceiling height, or the use of beams that do not provide the necessary headroom for the use of conventional counterbalance systems.

In an attempt to accommodate structures having minimal headroom, efforts have been made to modify conventional counterbalance systems. For example, one alternative is to move the cable storage drums laterally outboard of the tracks, and lowered to a point that the drive tube and brackets supporting the drive tube just permit clearance with the opening. However, such a configuration has serious limitations. The cables used in such a counterbalance system may bind due to the outward force applied during operation. Furthermore, even though this modified conventional counterbalance system reduces the necessary headroom from thirteen or fourteen inches to about twelve inches, the space required on either side of the tracks is increased, which may produce a problem in some instances.

Another alternative is a reversion to the use of one-piece door systems. These one-piece door systems, which may or may not employ tracks, normally pivot the door about a point approximately vertically medial of the door opening. One-piece door systems have not achieved substantial acceptance due to one or more of a combination of disadvantages. These systems require a substantial assured clearance either inside or outside the door any time it is opened or closed, depending on whether the door swings inwardly or outwardly. Furthermore, these systems require additional side clearance to accommodate the pivoting mechanism and counterbalance system thereof. Moreover, one-piece door systems cannot be packed, shipped, transported, or installed easily.

Yet another alternative contemplates the movement of the entire counterbalance system to the rear of the horizontal sections of the tracks. That is, the counterbalance system will be positioned proximate the extremities of the horizontal sections where the top panel of the sectional door reposes when the sectional door is opened. In such counterbalance systems, it is necessary to specially route the cables from the cable storage drums. For example, these cables are routed horizontally from the counterbalance system to the door frame, and using pulleys, are routed vertically to the lower extremities of the bottom panel. Such counterbalance systems have proven to be costly, and introduce an unsightly mechanism located centrally of the residential garage or utility building. As such, the springs of the counterbalance system are totally exposed to the interior of the garage, rather than being adjacent the opening where a person standing inside the garage may be exposed to the possibility of injury. Further, such systems often result in a geometry where the bottom panel nevertheless hangs down into the door opening when the door is in the open horizontal position.

Consequently, there is a need for a method and apparatus for positioning a sectional door above the door opening in the fully open position when the residential building or utility building in which the sectional door is located has minimal headroom clearance.

DISCLOSURE OF THE INVENTION

Therefore, an object of the present invention is to provide an apparatus for positioning a sectional door in the fully open position in a low headroom environment. Another object of the present invention is to provide an apparatus that may be adjusted for use in differing door system geometries including conventional guide track systems.

A further object of the present invention is to provide such a device and method that can be used with preexisting sectional doors. Another object of the present invention is to embody the device in a roller stop. Still another object of the present invention is to provide a method for using such a roller stop.

A further object of the present invention is to provide a roller stop that can be attached to horizontal portions of track used to guide the sectional door between open and closed positions. A still further object of the present invention is to provide a roller stop that is configured to engage rollers attached to panels of the sectional door.

Yet another object of the present invention is to provide a roller stop having a ribbon-shaped section. Yet a further object of the present invention is to provide a first clamping member and a second clamping member attached to either end of the ribbon shaped section. Yet a further object of the present invention is to attach the roller stop to the horizontal portions of track using the first clamping member and second clamping member.

Still another object of the present invention is to configure the ribbon-shaped section with a concave portion interposed between two convex portions. Still yet another object of the present invention is to trap the rollers between the two convex portions to hold the sectional door in the fully open position.

In general, the present invention contemplates a roller stop for a sectional door having a plurality of hinged panels, rollers attached to the panels, and a pair of tracks receiving the rollers for guiding the sectional door between a closed vertical position and an open horizontal position, the roller stop having, a body portion, and at least one clamping member associated with the body portion adapted to engage one of the tracks, wherein the body portion is adapted to contact at least one of the rollers to temporarily maintain the sectional door in a predetermined position.

BEST MODE FOR CARRYING OUT THE INVENTION

Figure 1:
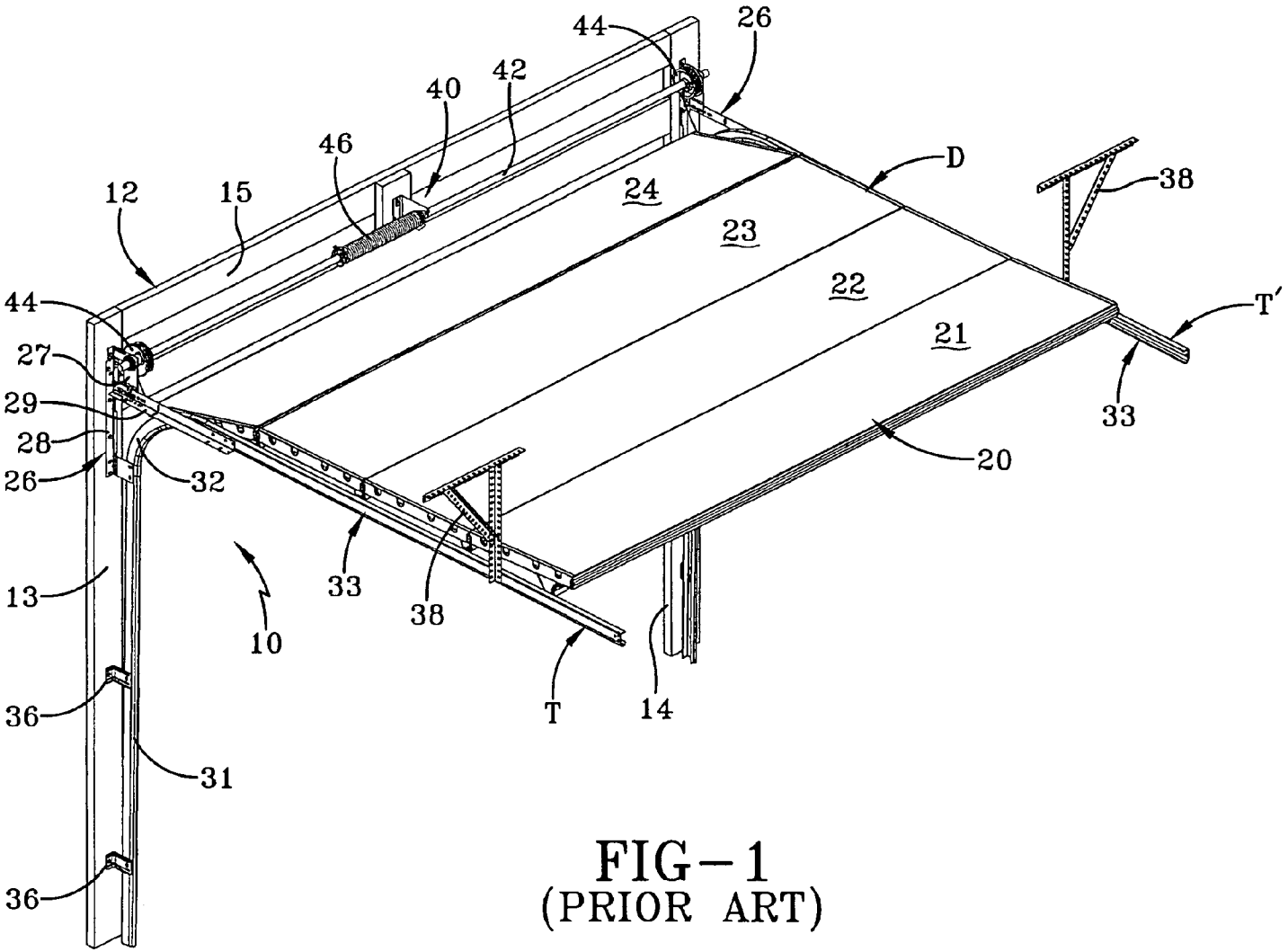
FIG-1 (PRIOR ART)
FIG. 1 is a rear perspective view of an exemplary prior art sectional door depicting the bottom panel hanging down in the door opening pursuant a typical installation.
Figure 2:
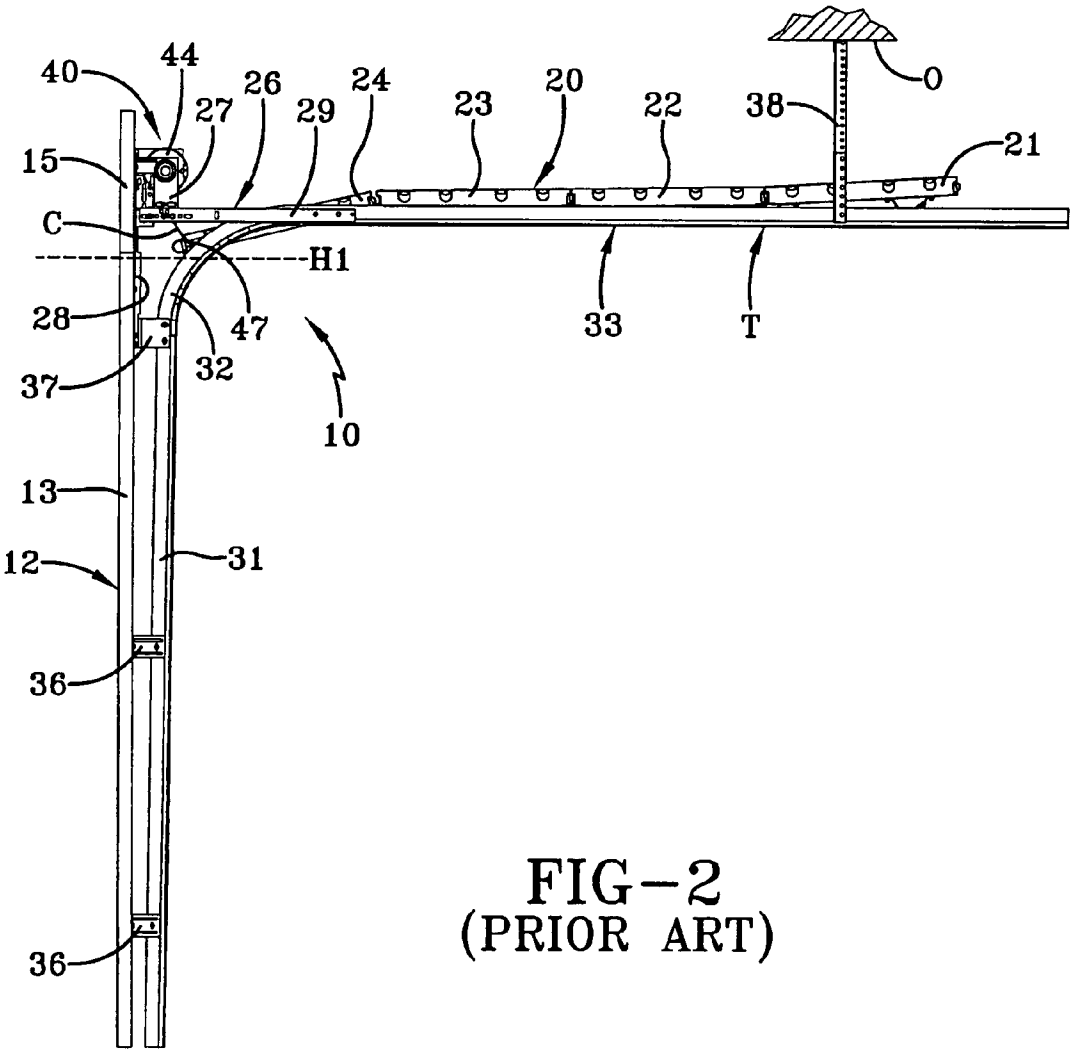
FIG-2 (PRIOR ART)
FIG. 2 is a side elevational view of the sectional door of FIG. 1 in the open horizontal position.
Figure 3:
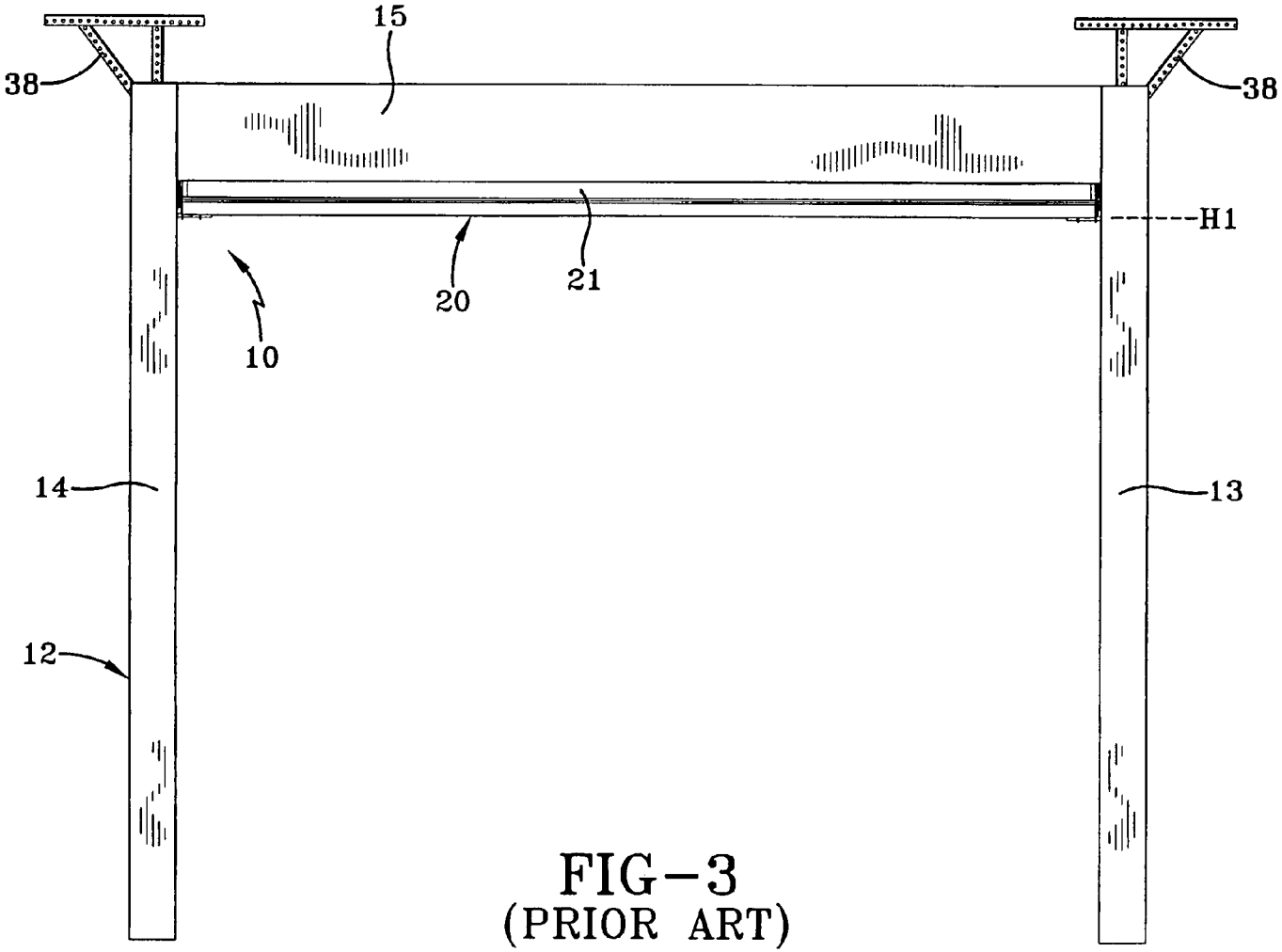
FIG-3 (PRIOR ART)
FIG. 3 is a front elevational view of the door opening and the front of the sectional door of FIG. 1 in the open horizontal position.

With initial reference to FIGS. 1–3, a conventional prior art door system is generally indicated by the numeral 10. The sectional door system 10 is of the type commonly employed in residential garages, utility buildings, and the like. The opening to which the sectional door system 10 is positioned for opening and closing is surrounded by a door frame, generally indicated by the numeral 12.

The door frame 12 consists of a pair of spaced jambs 13 and 14 that are generally parallel. The jambs 13 and 14 extend in a vertical direction upwardly from the garage floor, and are joined at their vertical upper extremities by a header 15. The jambs 13 and 14, and the header 15 provide a U-shaped door frame 12 around the opening for attaching components of the sectional door system 10 thereto.

As seen in FIG. 1, the sectional door system 10 includes a door D having a rectangular arrangement of panels 20, which when positioned in the substantially vertical closed position provide a top panel 21, an adjacent upper middle panel 22, an adjacent lower middle panel 23, and an adjacent bottom panel 24. As is known in the art, adjacent panels 21, 22, 23, and 24 of the arrangement of panels 20 are hingedly connected to one another along their vertical interfaces. To illustrate, the lower extremity of the upper middle panel 22 and the upper extremity of the lower middle panel 23 are hingedly connected to one another along their interface, thereby allowing for the articulation of the upper middle panel 22 and lower middle panel 23 with respect to one another.

Proximate to the upper extremities of the jambs 13 and 14, and the lateral extremities of the header 15, flag angles 26 are attached to the jamb 13 and 14 on either side of the sectional door system 10. The flag angles 26 are generally L-shaped, and each have a body 27 with a first leg 28 and a second leg 29. The first leg 28 and second leg 29 are perpendicular to one another, and a joined together using the body 27. The first leg 28 is attached to the jambs 13 and 14, and the second leg 29 is positioned in supporting relation to tracks T, T'.

The tracks T, T' are located on either side of the sectional door system 10, and provide a guide system for movement of the sectional door system 10 between a substantially vertical closed position and a substantially horizontal open position. The tracks T, T' are mirror images of one another, and are adapted to receive rollers 30. The rollers 30 are positioned along the adjacent panels 21, 22, 23, and 24, and allow for articulation thereof with respect to the tracks T, T'. The tracks T, T' both include a vertical track portion 31, a transitional track portion 32, and a horizontal track portion 33, which allow for movement of the arrangement of panels 20 between the open and closed positions.

The tracks T, T', and more specifically, the vertical track portion 31 is supported relative to the frame 12 by angle brackets 36 extending outwardly from the jambs 13 and 14. For example, the angle brackets 36 are spaced vertically along the jambs 13 and 14, and are attached to the vertical track portion 31. Also supporting the vertical track portion 31 (adjacent the transitional track portion 32) is an extension plate 37 attached to the first leg 28 of flag angles 26. The horizontal track portion 33 is supported by the second leg 29 of flag angles 26, and by struts 38 extending downwardly from the overhead O.

Still referring to FIGS. 1–3 of the drawings, sectional door system 10 has a counterbalance system, generally indicated by the numeral 40. As shown, the counterbalance system 40 includes a drive tube 42 and cable storage drums 44 positioned at either end of the drive tube 42, and a spring 46 positioned proximate the center of the drive tube 42. The drive tube 42 is supported by the body portions 27 of the flag angles 26. The storage drums 44 each have a cable C attached thereto and reeved thereabout. The cable C is affixed to the door D, preferably proximate the bottom, such that the rotation of the cable storage drums 44 serves to open or close the door D. As seen in FIG. 2, the cable C is attached to the lower extremity of the bottom panel 24 at 47. The cable C is preferably a conventional stranded steel cable that may or may not be coated.

The counterbalance system 40 can work in conjunction with an operator (not shown), which may conveniently enclose a length of the drive tube 42, or be a typical jack shaft operator connected by gears, pulleys, or the like to selectively rotatably power the drive tube 42. Alternatively, a conventional trolley type operator may be attached to top panel 21 of door system 10.

The spring 46, acting through the cable C, is configured to assist the opening movement of the sectional door system 10. For example, the spring 46 is loaded as the sectional door system 10 moves into the fully closed position. As such, the unloading of the spring 46 produces a force operating through the cable C that assists with the opening movement of the sectional door system 10. Ideally, the spring 46 should assist with opening of the sectional door system 10 to the fully open position, where the panels 20 are all substantially horizontal. However, when the counterbalance system 40 is configured for low headroom operation, the spring 46 is capable of assisting with the opening movement of the sectional door system 10 only to a height below the fully open position. For example, as seen in FIGS. 2 and 3, because of the location of the counterbalance system 40 relative to the tracks T, T', the spring 46 can only assist with opening of the sectional door system 10 to a height H1 measured to the bottom edge of the bottom panel 24.

The location of the counterbalance system 40 relative to the tracks T, T' determines the height H1. For example, the spring 46 is predisposed to retract the cable C around the cable storage drums 44. However, the cable C is attached to the bottom panel 24, and the movement of the bottom panel 24 is restricted by the tracks T, T'. Therefore, the amount of cable C that can be retracted is constrained by the movement of the bottom panel 24 relative to the cable storage drums 44. Nevertheless, given these constraints, the spring 46 acts to retract as much cable C as possible. As such, the spring 46 is biased to pull the attachment point 47 as close to the cable storage drums 44 as possible, at which time the counterbalance force approaches zero.

The attachment point 47 of the cable C is nearest to the cable storage drums 44 when the bottom edge of panel 24 is at the height H1. At height H1, the panel 24 is partially disposed along the transitional track portion 32, and therefore, the sectional door system 10 is not in the fully open position. As seen in FIG. 3, the height H1 is lower than the height of the header 15. Consequently, the sectional door system 10 "hangs down" into the opening defined by the frame 12. Even if the spring 46 had tension remaining therein when the sectional door system 10 is at height H1, such tension could not be used to open the sectional door system 10 further. The attachment point 47 of cable C is as close to the cable storage drums 44 as possible.

Movement (either opening or closing) away from height H1 along the tracks T, T' only serves to increase tension in the spring 46, and bias the sectional door system 10 toward the position of the height H1. For example, as the sectional door system 10 moves substantially to the fully open position, the length of cable C drawn from the cable storage drums 44 is increased, and therefore, the spring 46 is increasingly tension loaded. Consequently, the sectional door system 10 would resist movement past the position of height H1 toward the fully open position.

To overcome such resistance, the roller stop, generally indicated by the numeral 50, is configured to maintain the sectional door system 10 in the fully open position. The roller stop 50 can be positioned in various places along one or both of the horizontal track portions 33 of the tracks T, T', and as such, can engage different rollers 30. For example, in FIGS. 4-6, the roller stop 50 is provided near the distal end of the horizontal track portion 33, and is configured to engage the rollers 30 provided near the upper extremity of the upper panel 21.

Figure 4:
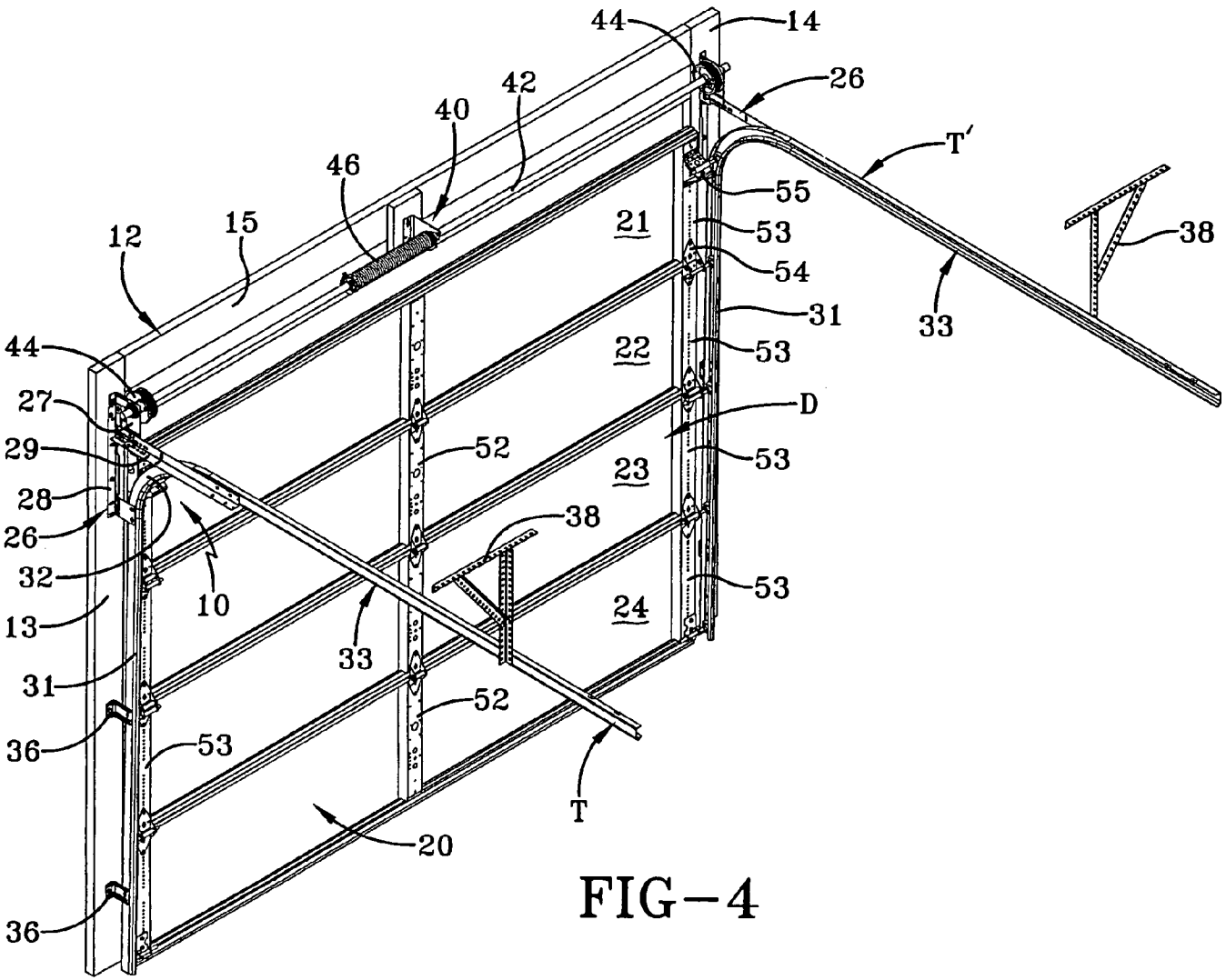
FIG. 4 is a rear perspective view of a sectional door embodying the concepts of the present invention shown in the closed vertical position.
Figure 4A:
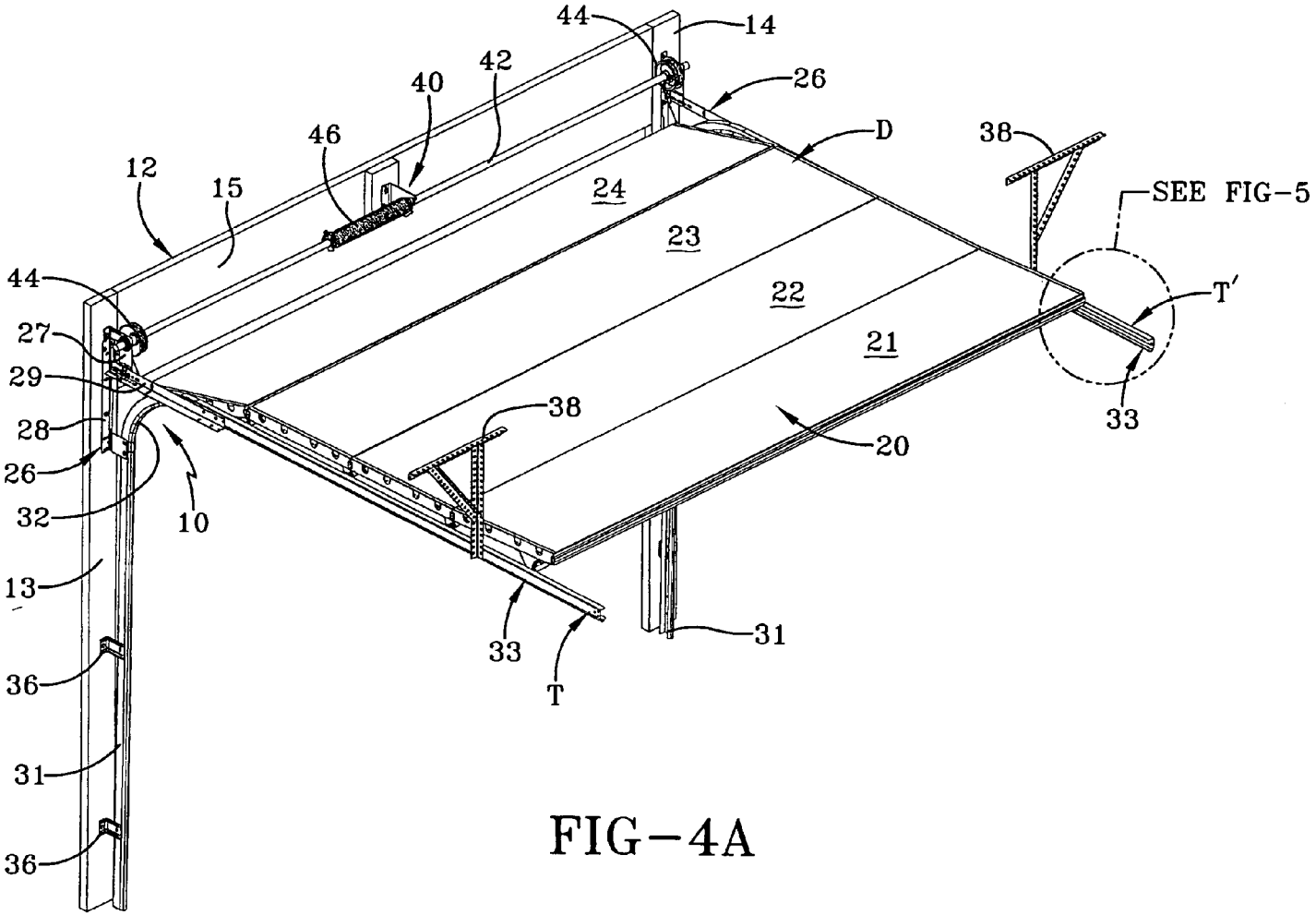
FIG. 4A is a rear perspective view of a sectional door of FIG. 4 in the open horizontal position with no bottom panel hang down.
Figures 5, 5A:
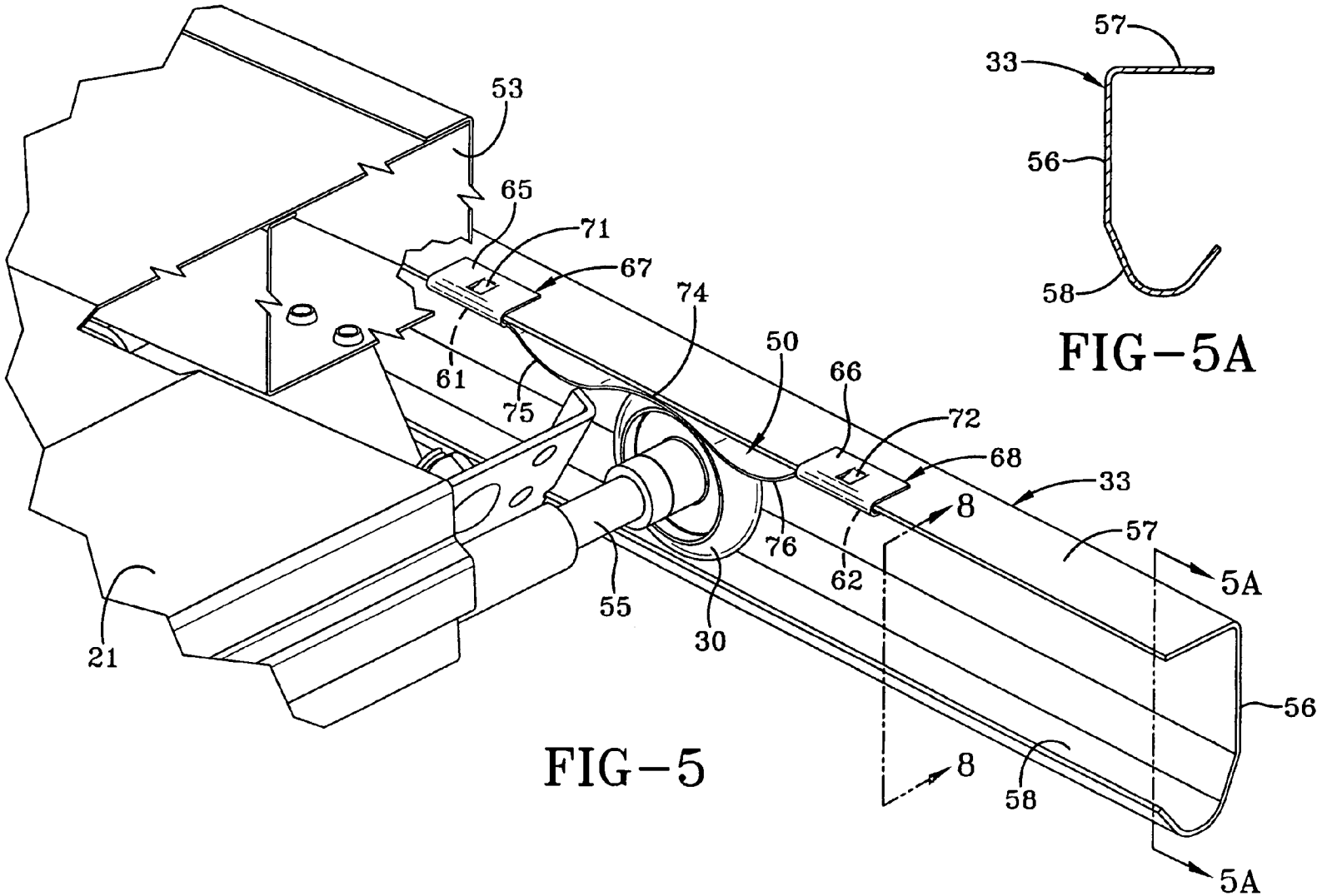
FIG. 5 is an enlarged fragmentary upper rear perspective view of the sectional door of FIG. 4 in the position depicted in FIG. 4A showing details of the roller stop of the present invention.
FIG. 5A is a sectional view of the horizontal track portions taken substantially along the line 5A—5A of FIG. 5.

Referring to FIGS. 4, 4A, and 5, reinforcing stiles 52 and 53 are positioned along each of the panels 21, 22, 23, and 24. More specifically, center stiles 52 are positioned along the vertical center-line and end stiles 53 along the vertical edge portions of the panels 21, 22, 23, and 24. The reinforcing stiles 52, 53 increase the structural rigidity of the panels 21, 22, 23, and 24, and provide surfaces for attaching hinge brackets 54. The rollers 30 are attached proximate the interfaces of adjacent panels 21, 22, 23, and 24 using the hinge brackets 54, which also serve to hingedly connect adjacent panels 21, 22, 23, and 24. Furthermore, roller brackets 55 are attached to the reinforcing stiles 52, and serve to attach the rollers 30 to the lower extremity of the bottom panel 24 and to the upper extremity of the top panel 21.

Figure 6:
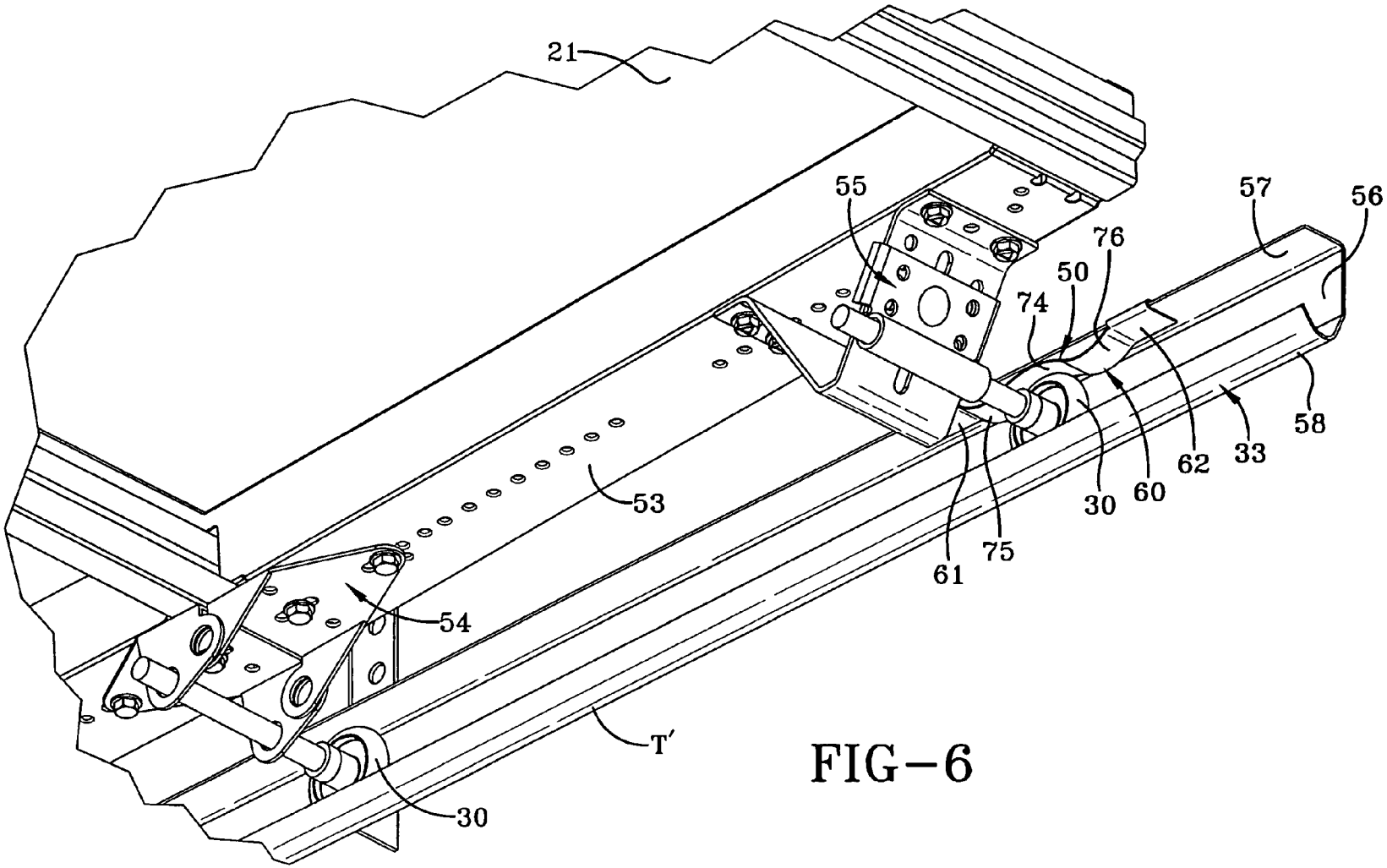
FIG. 6 is an enlarged fragmentary lower rear perspective view of the sectional door of FIG. 4 showing additional details of the roller stop.

The interface between the roller stop 50 and the rollers 30 provided on the upper extremity of the top panel 21 is depicted in FIGS. 5 and 6. As seen in FIG. 5A, the horizontal track portions 33 of the tracks T, T' are formed in cross-section by a body section 56, an extension section 57, and a C-shaped section 58. The extension section 57 extends outwardly from the vertical upper extremity of the body section 56 substantially perpendicular thereto. The C-shaped section 58 also extends outwardly from the body section 56, and is adapted to cradle the rollers 30. For example, when the rollers 30 are inserted into the horizontal track portions 33, the rollers 30 interface with the C-shaped section 58 and maintain a substantial interface therewith during their travel within the horizontal track portions 33.

Figure 7:
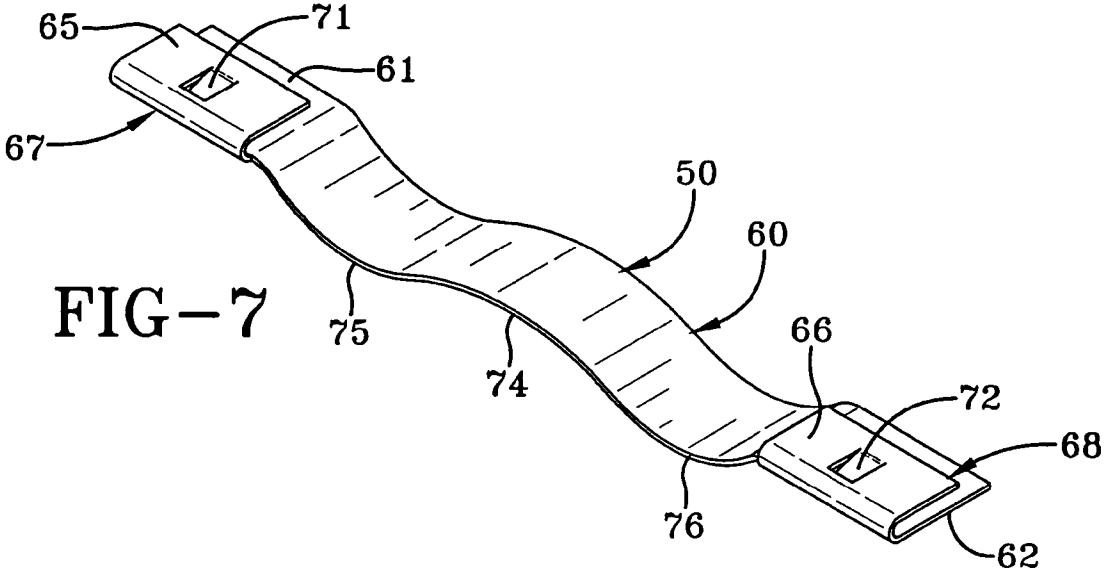
FIG. 7 is a perspective view of the roller stop detached from the track.
Figure 8:
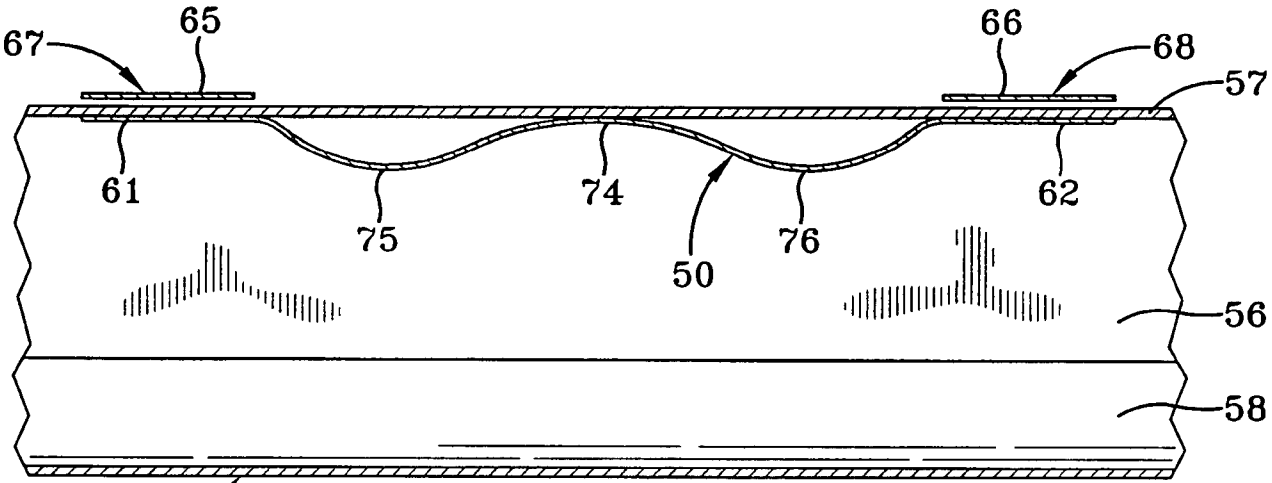
FIG. 8 is a section view of the roller stop and horizontal track portions taken substantially along the line 8—8 of FIG. 5.

As seen in FIGS. 5, 6, and 8, the roller stop 50 is attached to the extension section 57 of horizontal track portions 33 and as further seen in FIG. 7 includes an elongate ribbon-shaped body 60, and first and second extension arms 61, 62 extending outwardly from either end of the ribbon-shaped body 60. A first opposed section 65 is attached to the first extension arm 61, and together form a U-shaped first spring clamping member 67. A second opposed section 66 is attached to the second extension arm 62, and together form a U-shaped second spring clamping member 68.

The roller stop 50 is positioned on the horizontal track portion 33 by inserting the first spring clamping member 67 and second spring clamping member 68 onto the extension section 57. Both parts of the first spring clamping member 67 and second spring clamping member 68 frictionally engage the extension section 57 to maintain any selected position thereon. Additionally, a first tab 71 and a second tab 72 may be provided in the first and second extension arms 61, 62, respectively, or opposed sections 65 and 66, as shown. The first tab 71 and second tab 72 can be crimped against the extension section 57 to further secure the roller stop 50 to the horizontal track portions 33.

Figure 9:
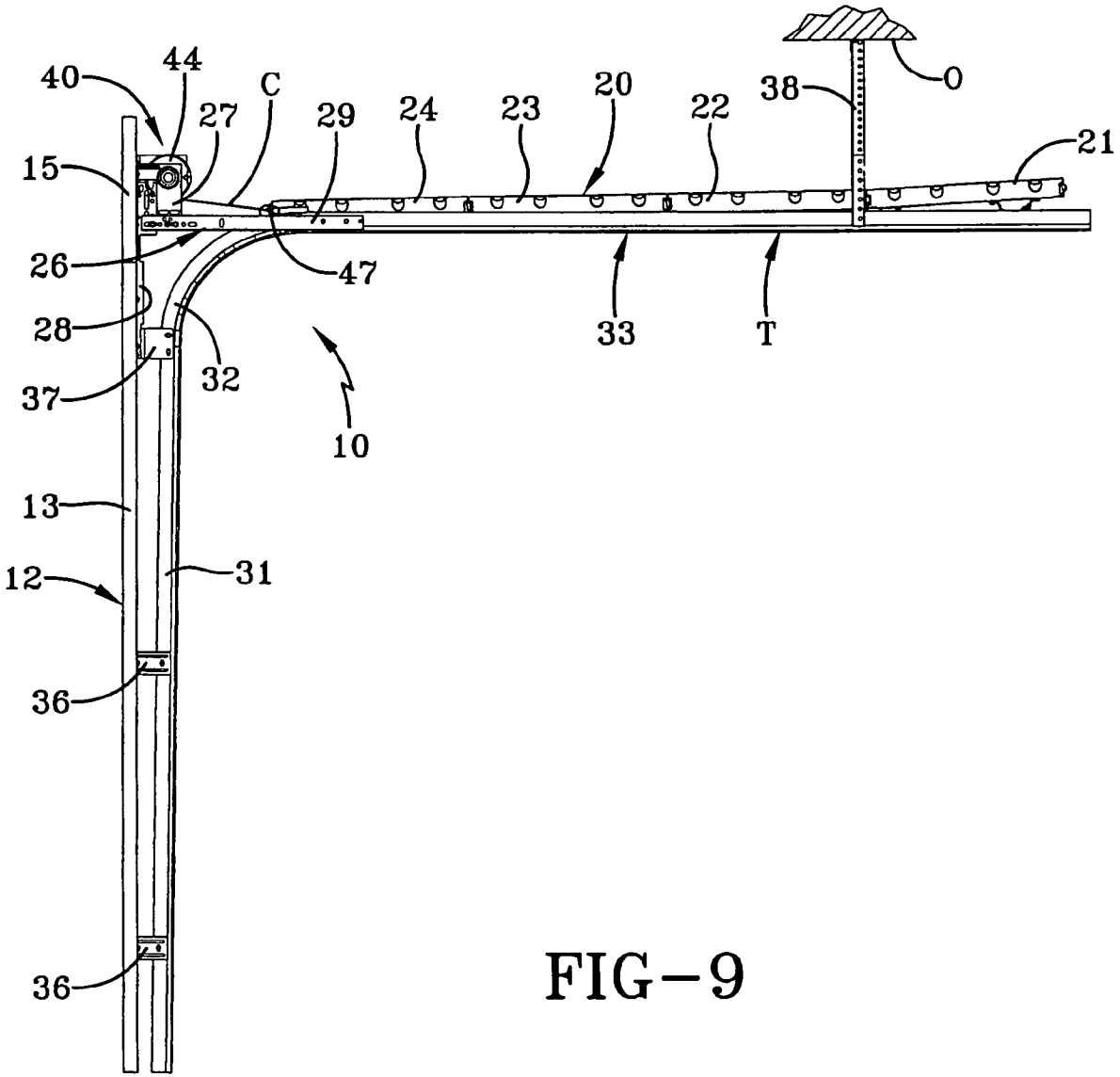
FIG. 9 is a side elevational view of the sectional door of FIG. 4 showing the door in the open horizontal position.
Figure 10:
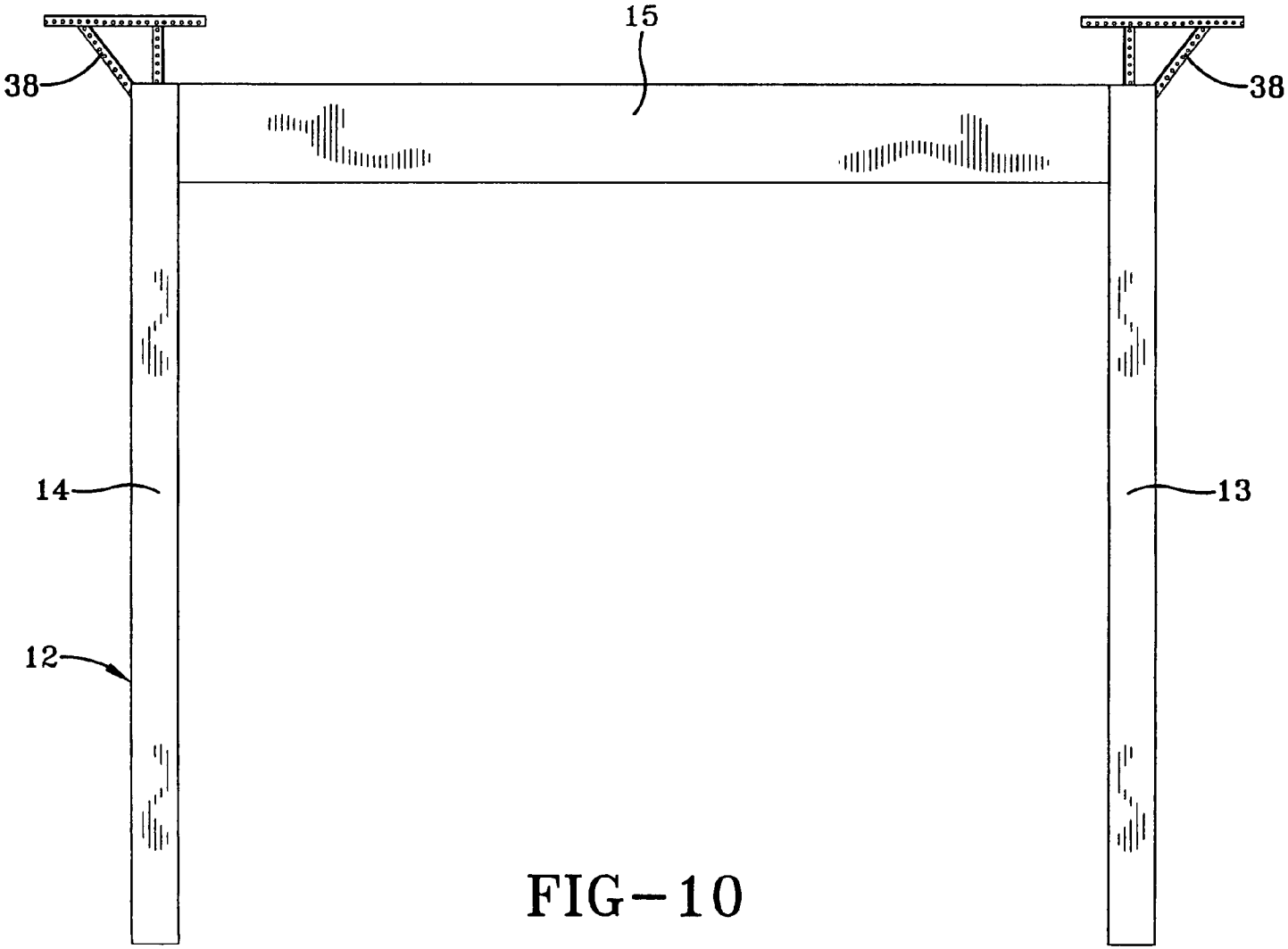
FIG. 10 is a front elevational view of the door opening with sectional door of FIG. 4 in the open horizontal position.

The ribbon-shaped body 60 of the roller stop 50 includes a concave portion 74 interposed between a first convex portion 75 and a second convex portion 76. The ribbon-shaped body 60 is capable of receiving the rollers 30 in concave portion 74 and temporarily maintaining the rollers 30 in a predetermined position until positively displaced therefrom. That is, the shape of the ribbon-shaped body 60 is configured to trap the rollers 30 between the first convex portion 75 and second convex portion 76 substantially in the concave portion 74 when the sectional door system 10 is in the fully open position and hold the rollers 30. Therefore, using the roller stop 50, the sectional door system 10 can be held in the fully open, substantially horizontal position as seen in FIGS. 9–10, even though the spring 46 acting through the cable C is slightly biased to return the sectional door system 10 to the position where bottom section 24 is hanging down to the position of height H1.

The roller stop 50 can be made from a number of semi-rigid materials, such as spring steel, plastics, and tempered nonferrous materials. For example, the ribbon-shaped body 60 preferably flexes or deforms when the rollers 30 engage the first convex portion 75. However, the ribbon-shaped body 60 should be sufficiently rigid to hold the sectional door system 10 in place with both slight gravitational force and the force of the spring 46 acting thereon when the rollers 30 are held between the first convex portion 75 and second convex portion 76. Using the roller stops 50 to hold the sectional door system 10 in the fully open, substantially horizontal position allows access through the opening defined by the frame 12 by vehicles having heights substantially equal to the vertical height of the header 15. Either an operator or manual operation of the door system 10 displaces the rollers 30 from the roller stops 50 when the door is to be moved from the open horizontal position to the closed vertical position. Further, door stop 50 can be placed at any desired position along the extension section 57 of a horizontal track portion 33 to locate bottom section 24 without hang down with different parameters of door system 10 and other differing design characteristics.

As such, during operation of the sectional door system 10, the roller stop 50 is capable of positioning the door D in a substantially horizontal open position. For example, to position the door D in a substantially horizontal open position, the panels 20 are first moved by transitioning them along the tracks T, T' from the substantially vertical closed position to the substantially horizontal open position. Second, the door D is displaced in the tracks T, T' to the substantially horizontal open position to locate bottom section 24 without hang down in the opening to which the sectional door system 10 is positioned. During such displacement of the door D, it may be necessary to overcome the counterbalance force of spring 46. The counterbalance force of spring 46 resists movement of the door D to the substantially horizontal open position, and tends to retract the door D so that the bottom section 24 is located at the position of height H1. Third, the door D is restrained, at least temporarily, by the roller stop 50 in the substantially horizontal open position without hang down. As the counterbalance force of spring 46 tends to retract the door D when in the substantially horizontal open position, the roller stop 50 is configured to counteract the counterbalance force and restrain movement of the door D.

Thus, it should be evident that the roller stop 50 for a sectional door relative to an opening disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

The invention claimed is:

1. A roller stop for a sectional door having a plurality of hinged panels, rollers attached to the panels, and a pair of tracks receiving the rollers for guiding the sectional door between a closed vertical position and an open horizontal position, the roller stop comprising, a body portion, and at least one clamping member associated with said body portion adapted to engage one of the tracks, wherein said body portion is adapted to contact at least one of the rollers to temporarily maintain the sectional door in a predetermined position, wherein a first clamping member and a second clamping member are adapted to attach the roller stop to the tracks, wherein said first clamping member includes a first extension arm springingly related to a first opposed section, and said second clamping member includes a second extension arm springingly related to a second opposed section, and wherein a first tab is provided in said first extension arm and a second tab is provided in said second extension arm, said first tab and said second tab adapted to crimpingly engage the tracks.

2. A roller stop according to claim 1, wherein said body portion is ribbon-shaped and includes a concave portion interposed between a first convex portion and a second convex portion, said concave portion being adapted to receive the rollers.

3. A roller stop according to claim 2, wherein when the sectional door is located in said predetermined position, said first convex portion and said second convex portion are adapted to trap the rollers in said concave portion.

4. A sectional door system comprising, a sectional door having a plurality of adjacent panels hinged for moving between a closed substantially vertical position and a open substantially horizontal position, rollers attached to said panels, a pair of tracks for receiving and guiding said rollers, and a roller stop to temporarily hold said sectional door in a predetermined position, said roller stop having a ribbon-shaped body adapted to trap said rollers, having a first arm extending from one end of said ribbon-shaped body with a first opposed section attached to said first arm and forming a first U-shaped spring clamping member therewith, and having a second arm extending from the other end of said ribbon-shaped body with a second opposed section attached to said second arm and forming a second U-shaped spring clamping member therewith, whereby said first U-shaped spring clamping member and said second U-shaped spring clamping member frictionally engage one of said pair of tracks to maintain said roller stop at any selected predetermined position.

5. A sectional door system according to claim 4, wherein said tracks include vertical track portions and horizontal track portions, and said roller stop is attached to said horizontal track portions.

6. A sectional door system according to claim 4, wherein a first tab is provided on said first U-shaped spring clamping member and a second tab is provided on said second U-shaped spring clamping member, said first tab and said second tab being crimped to engage said one of said pair of tacks.

7. A sectional door system comprising, a sectional door having a plurality of adjacent panels hinged for moving between a closed substantially vertical position and a open substantially horizontal position, rollers attached to said panels, a pair of tracks for receiving and guiding said rollers, and a roller stop to temporarily hold said sectional door in a predetermined position, wherein said roller stop includes a ribbon-shaped body, and a first clamping member and second clamping member extending outwardly from either end of said ribbon-shaped body, said ribbon-shaped body being adapted to trap said rollers, wherein said first clamping member and said second clamping member attach said roller stop to said tracks, wherein said first clamping member includes a first extension arm and a first opposed section and said second clamping member includes a second extension arm and a second opposed section, wherein a first tab is provided in said first extension arm and a second tab is provided in said second extension arm, said first tab and said second tab being crimped to engage said tracks.

8. A sectional door system according to claim 7, wherein said ribbon-shaped body includes a concave portion interposed between a first convex portion and a second convex portion, said concave portion being adapted to receive said rollers.

9. A sectional door system according to claim 8, wherein when said sectional door is located in said predetermined position, said rollers are trapped between said first convex portion and said second convex portion proximate said concave portion.

* * * * *

UNITED STATES PATENT AND TRADEMARK OFFICE

CERTIFICATE OF CORRECTION

PATENT NO. : 7,036,548 B2
APPLICATION NO. : 10/803524
DATED : May 2, 2006
INVENTOR(S) : Edward C. Johnston and James M. West It is certified that error appears in the above-identified patent and that said Letters Patent is hereby corrected as shown below:

In Claim 6, column 10, line 19 the word “tacks” should be “tracks”

Signed and Sealed this

Twentieth Day of November, 2007

JON W. DUDAS
*Director of the United States Patent and Trademark Office*